US009528748B2

(12) United States Patent
Joo et al.

(10) Patent No.: US 9,528,748 B2
(45) Date of Patent: Dec. 27, 2016

(54) REFRIGERATOR

(71) Applicant: SAMSUNG ELECTRONICS CO., LTD., Suwon-si (KR)

(72) Inventors: Sun Hwan Joo, Gwangju (KR); Seung Yong Yang, Gwangju (KR); Sang Gyu Jung, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/554,558

(22) Filed: Nov. 26, 2014

(65) Prior Publication Data

US 2015/0145399 A1 May 28, 2015

(30) Foreign Application Priority Data

Nov. 27, 2013 (KR) ..... 10-2013-0145037

(51) Int. Cl.
*A47B 96/04* (2006.01)
*F25D 23/02* (2006.01)

(52) U.S. Cl.
CPC ..... *F25D 23/02* (2013.01); *F25D 2400/18* (2013.01); *Y10T 29/49826* (2015.01); *Y10T 29/49906* (2015.01)

(58) Field of Classification Search
CPC ..... F25D 23/028; F25D 23/00; F25D 23/065; F25D 23/02; F25D 2400/18; A47L 15/4265
See application file for complete search history.

(56) References Cited

U.S. PATENT DOCUMENTS 3,648,411 A * 3/1972 Saunders ..... E05B 1/0015 16/412
4,087,143 A * 5/1978 Barnard ..... E05D 7/1061 126/190
4,229,921 A * 10/1980 Schell ..... E06B 5/006 126/190
4,745,656 A * 5/1988 Revlett ..... E05B 1/0015 16/412
5,353,154 A * 10/1994 Lutz ..... B29C 51/14 359/582
5,358,326 A * 10/1994 Cherry ..... F25D 23/02 312/265.6
5,571,276 A * 11/1996 Kobos ..... A47L 15/4265 312/109
5,603,557 A * 2/1997 Marks ..... A47L 15/4251 312/265.6

(Continued)

FOREIGN PATENT DOCUMENTS

JP 2002-13867 1/2002
KR 10-2010-0117919 11/2010

*Primary Examiner* — Hanh V Tran
(74) *Attorney, Agent, or Firm* — Staas & Halsey LLP

(57) ABSTRACT

A refrigerator includes a main body, a storage chamber provided in the main body, and a door opening and closing the storage chamber, wherein the door includes a front panel comprising a front portion forming a front exterior of the door, an edge portion bent from the front portion and a side portion bent from the edge portion and forming a side exterior, a rear panel coupled to a rear side of the front panel, an insulation material provided at an inner space defined by the front panel and the rear panel, and a decorative member coupled to the edge portion and forming an exterior. Due to such a configuration, the edge portion of the door has enhanced aesthetic appeal.

17 Claims, 12 Drawing Sheets

(56) References Cited

U.S. PATENT DOCUMENTS 5,740,587 A * 4/1998 Onai ..... A47B 95/02 16/412
5,908,227 A * 6/1999 Wilhelmstatter ..... A47B 77/08 312/204
D657,179 S 4/2012 Cupples et al.
8,851,584 B2 * 10/2014 Seo ..... F25D 23/028 312/204
9,243,836 B2 * 1/2016 Kim ..... F25D 23/02
2003/0205954 A1 * 11/2003 Oyler ..... A47L 15/4265 312/311
2004/0201337 A1 * 10/2004 Wuestefeld ..... A47L 15/4265 312/311
2005/0017605 A1 * 1/2005 Bauer ..... B32B 15/08 312/204
2006/0141197 A1 * 6/2006 Caparros Taracido ..... A47L 15/4251 428/40.1
2008/0000052 A1 * 1/2008 Hong ..... E05B 17/0033 16/382
2008/0042537 A1 * 2/2008 Kim ..... F25D 23/02 312/405
2008/0244869 A1 * 10/2008 Bae ..... A47B 95/02 16/412
2009/0007587 A1 * 1/2009 Lanzl ..... A47F 3/0434 62/449
2010/0031580 A1 * 2/2010 Lee ..... F25D 23/028 49/504
2010/0123379 A1 * 5/2010 Crookshanks ..... A47B 88/0044 312/404
2010/0141102 A1 * 6/2010 Jung ..... A47L 15/4265 312/204
2010/0287843 A1 * 11/2010 Oh ..... E05B 1/0015 49/460
2010/0327721 A1 * 12/2010 Pae ..... F25D 23/028 312/405
2011/0010923 A1 * 1/2011 Guarino ..... F25D 23/02 29/592
2012/0104002 A1 * 5/2012 Jung ..... F25D 21/04 220/592.27
2012/0104909 A1 * 5/2012 Kaplan ..... F25D 23/02 312/204
2012/0145662 A1 * 6/2012 Geng ..... F16B 5/07 211/175
2013/0050992 A1 * 2/2013 Schneider ..... F25D 23/028 362/100
2013/0099650 A1 * 4/2013 Lee ..... F25D 23/028 312/404
2013/0164483 A1 * 6/2013 Cites ..... B32B 17/10036 428/68
2014/0110414 A1 * 4/2014 Piendl ..... F25D 23/065 220/592.02
2015/0247668 A1 * 9/2015 Willis ..... F25B 49/02 62/129

* cited by examiner

REFRIGERATOR

CROSS-REFERENCE TO RELATED APPLICATIONS

This application claims the priority benefit of Korean Patent Application No. 10-2013-0145037, filed on Nov. 27, 2013 in the Korean Intellectual Property Office, the disclosure of which is incorporated herein by reference.

BACKGROUND

1. Field

The following description relates to a decorative structure of a door of a refrigerator, which has a front panel formed from a steel plate material.

2. Description of the Related Art

In general, a refrigerator is a home appliance for keeping food fresh which has a storage chamber for storing the food and a cold air supplying device for supplying cold air to the storage chamber. A front surface of the storage chamber is opened to store and take out the food, and a door is provided at a main body to open and close the storage chamber.

In such a door, there is a kind of door in which a front panel formed from a steel plate material and a rear panel formed from a resin material are coupled with each other. The front panel includes a front portion which is bent to form a front exterior of the door and a side portion which forms a side exterior of the door.

The front panel formed from the steel plate material has a cold and luxurious finish unique to the steel plate material. Further, a surface treatment such as a hairline may be performed on the front portion of the front panel in order to provide further aesthetic appeal.

However, a separate decorative structure is not generally provided at an edge portion between the front portion and the side portion of the front panel.

SUMMARY

Therefore, it is an aspect of the present disclosure to provide a refrigerator with a door which has enhanced aesthetic appeal by providing a decorative structure at an edge portion of the door.

Additional aspects of the disclosure will be set forth in part in the description which follows and, in part, will be obvious from the description, or may be learned by practice of the disclosure.

In accordance with an aspect of the present disclosure, a refrigerator includes a main body, a storage chamber provided in the main body, and a door opening and closing the storage chamber, wherein the door includes a front panel comprising a front portion forming a front exterior of the door, an edge portion bent from the front portion and a side portion bent from the edge portion and forming a side exterior of the door, a rear panel coupled to a rear side of the front panel, an insulation material provided at an inner space defined by the front panel and the rear panel, and a decorative member coupled to the edge portion and forming an exterior.

The front portion, the edge portion, and the side portion may be formed integrally by bending the front panel.

The front panel may be formed from a steel plate material.

The edge portion may be formed to be flat.

The decorative member may extend from an upper end of the door to a lower end thereof.

The decorative member may include a supporting surface which is in close contact with and supported by an outer surface of the edge portion and a decorative surface which is provided at an opposite side to the supporting surface to form an exterior.

The decorative surface may be formed to be rounded.

The decorative member may include a supporting layer formed from a resin material or an aluminum material and a gloss layer which is provided on the supporting layer to generate a gloss.

The supporting layer may be formed by injection-molding the resin material or extruding the aluminum material, and the gloss layer may be formed by plating the supporting layer with a metallic material.

The decorative member may be formed by dual-extruding the resin material and a gloss film having the gloss.

The refrigerator may further include a fixing member which is disposed at an inner side of the edge portion to fix the decorative member.

The decorative member may include a hooking protrusion protruding toward the fixing member.

The fixing member may include a corresponding protrusion which protrudes toward the decorative member to be coupled to the hooking protrusion and thus to fix the decorative member.

The edge portion may include a through-hole through which the hooking protrusion or the corresponding protrusion passes.

The fixing member may be supported by the insulation material.

The refrigerator may further include an adhesive member which is provided between the edge portion and the decorative member to fix the decorative member and thus to adhere the edge portion and the decorative member.

The refrigerator may further include a fastening member which passes through the decorative member and the edge portion to fix the decorative member, and a reinforcing member which is provided at the inner side of the edge portion to reinforce a fastening force of the fastening member.

In accordance with an aspect of the present disclosure, a method of manufacturing a refrigerator which comprises a main body, a storage chamber provided in the main body, and a door opening and closing the storage chamber includes preparing a front panel formed from a steel plate material, bending the front panel to form a front portion forming a front exterior of the door, an edge portion bent from the front portion and a side portion bent from the edge portion and forming a side exterior of the door, preparing a decorative member which is coupled to the edge portion and forms an exterior, and coupling the decorative member to the edge portion.

The preparing of the decorative member may include forming a supporting layer by injection-molding a resin material or extruding an aluminum material, and forming a gloss layer by plating the supporting layer with a metallic material.

The preparing of the decorative member may include forming the decorative member by dual-extruding a resin material and a gloss film having a gloss.

The coupling of the decorative member to the edge portion may include preparing a fixing member which is provided at an inner side of the edge portion to fix the decorative member, and coupling the decorative member and the fixing member through a hooking structure.

The coupling of the decorative member to the edge portion may include adhering the edge portion and the decorative member through an adhesive member.

The coupling of the decorative member to the edge portion may include providing a reinforcing member at an inner side of the edge portion, and fastening the decorative member, the edge portion and the reinforcing member using a fastening member.

In accordance with an aspect of the present disclosure, a refrigerator includes a main body, a storage chamber provided in the main body, and a door opening and closing the storage chamber, wherein the door includes a front panel, a rear panel coupled to a rear side of the front panel, an insulation material provided at an inner space defined by the front panel and the rear panel, an edge portion formed at an edge of the door, a decorative member coupled to the edge portion and forming an exterior, and a fixing member which is provided at the inner space of the door to fix the decorative member and supported by the insulation material.

The edge portion may have a through-hole through which a coupling structure coupling the decorative member and the fixing member passes.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
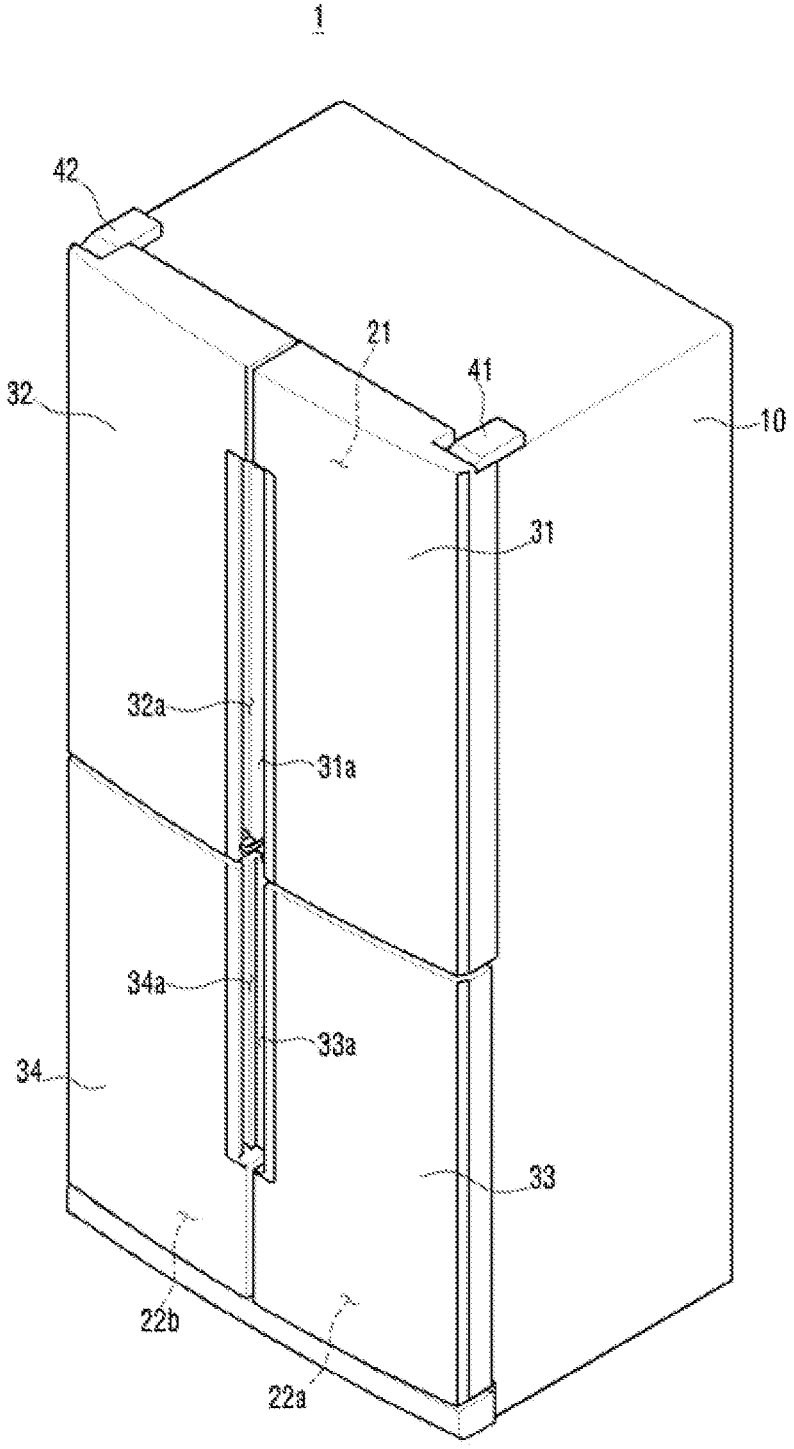
FIG. 1 is a view illustrating an exterior of a refrigerator in accordance with an embodiment of the present disclosure.

Reference will now be made in detail to the embodiments of the present disclosure, examples of which are illustrated in the accompanying drawings, wherein like reference numerals refer to like elements throughout. The embodiments are described below to explain the present disclosure by referring to the figures.

FIG. 1 is a view illustrating an exterior of a refrigerator in accordance with an embodiment of the present disclosure.

Referring to FIG. 1, a refrigerator 1 includes a main body 10 forming an exterior, storage chambers 21, 22*a*, and 22*b* which are formed in the main body 10 to store food, and a cold air supplying device (not shown) which supplies cold air to the storage chambers 21, 22*a*, and 22*b*.

The main body 10 includes an inner case (not shown) having approximately a box shape, an outer case, and an insulation material (not shown) which is provided between the inner case and the outer case.

A front surface of each of the storage chambers 21, 22*a*, and 22*b* is opened to access the food. The storage chambers 21, 22*a*, and 22*b* may be partitioned into an upper storage chamber 21 and lower storage chambers 22*a* and 22*b* by a horizontal partition wall (not shown). The lower storage chambers 22*a* and 22*b* may be partitioned again into a first lower storage chamber 22*a* and a second lower storage chamber 22*b* by a vertical partition wall (not shown).

The upper storage chamber 21 may be used as a refrigeration chamber, and the first and second lower storage chambers 22*a* and 22*b* may be respectively used as a refrigeration chamber and a freezer, if necessary.

The cold air supplying device may supply the cold air to the storage chambers 21, 22*a*, and 22*b* using a cooling cycle. To this end, the cold air supplying device includes a compressor (not shown), a condenser (not shown), an expansion valve (not shown), an evaporator (not shown), a blowing fan (not shown), and a refrigerant pipe (not shown).

The refrigerator 1 has doors 31, 32, 33, and 34 which open and close the opened front surface of each of the storage chambers 21, 22*a*, and 22*b*. The doors 31, 32, 33, and 34 may include a first upper door 31 and a second upper door 32 which open and close the upper storage chamber 21. Further, the doors 31, 32, 33, and 34 may include a first lower door 33 which opens and closes the first lower storage chamber 22*a* and a second lower door 34 which opens and closes the second lower storage chamber 22*b*.

The doors 31, 32, 33, and 34 may be rotatably coupled to the main body 10. Therefore, the doors 31, 32, 33, and 34 may be rotated to open and close the storage chambers 21, 22*a* and 22*b*. As an example, the first upper door 31 may be rotatably coupled to the main body 10 by a first upper hinge 41 and a first middle hinge (not shown), and the second upper door 32 may be rotatably coupled to the main body 10 by a second upper hinge 42 and a second middle hinge (not shown).

The doors 31, 32, 33, and 34 may have handles 31*a*, 32*a*, 33*a*, and 34*a* which a user grasps in order to open and close the doors 31, 32, 33, and 34. As illustrated in drawings, the handles 31 a, 32*a*, 33*a*, and 34*a* may be formed to be hidden, but are not limited thereto.

So far, a schematic configuration of the refrigerator 1 in accordance with the embodiment of the present disclosure has been described. However, this is merely an example, and the spirit of the disclosure is not limited to a kind of the refrigerator but may be applied to any kind of refrigerator which has a storage chamber and a cold air supplying device and keeps food fresh.

Meanwhile, the doors 31, 32, 33, and 34 may include a front panel 100 (FIG. 3) formed from a steel plate material, and a rear panel 200 (FIG. 3) formed from a resin material and coupled to a rear side of the front panel 100.

The front panel 100 formed from the steel plate material conveys a cold and luxurious feeling unique to the steel plate material. A surface treatment such as a hairline may be additionally performed on a front portion 110 (FIG. 3) of the front panel 100 in order to provide further aesthetic appeal.

Furthermore, a decorative member 600 (FIG. 3) having a gloss effect may be coupled to an edge portion 130 (FIG. 3) of the front panel 100 of the refrigerator in accordance with the present disclosure to enhance the aesthetic appeal.

Hereinafter, a detailed configuration of the doors 31, 32, 33, and 34 of the refrigerator in accordance with the present disclosure will be described. Because the doors 31, 32, 33, and 34 have the same configuration or correspond to each other, only the first upper door 31 will be explained, and the first upper door 31 will be simply referred to as the door.

Figure 2:
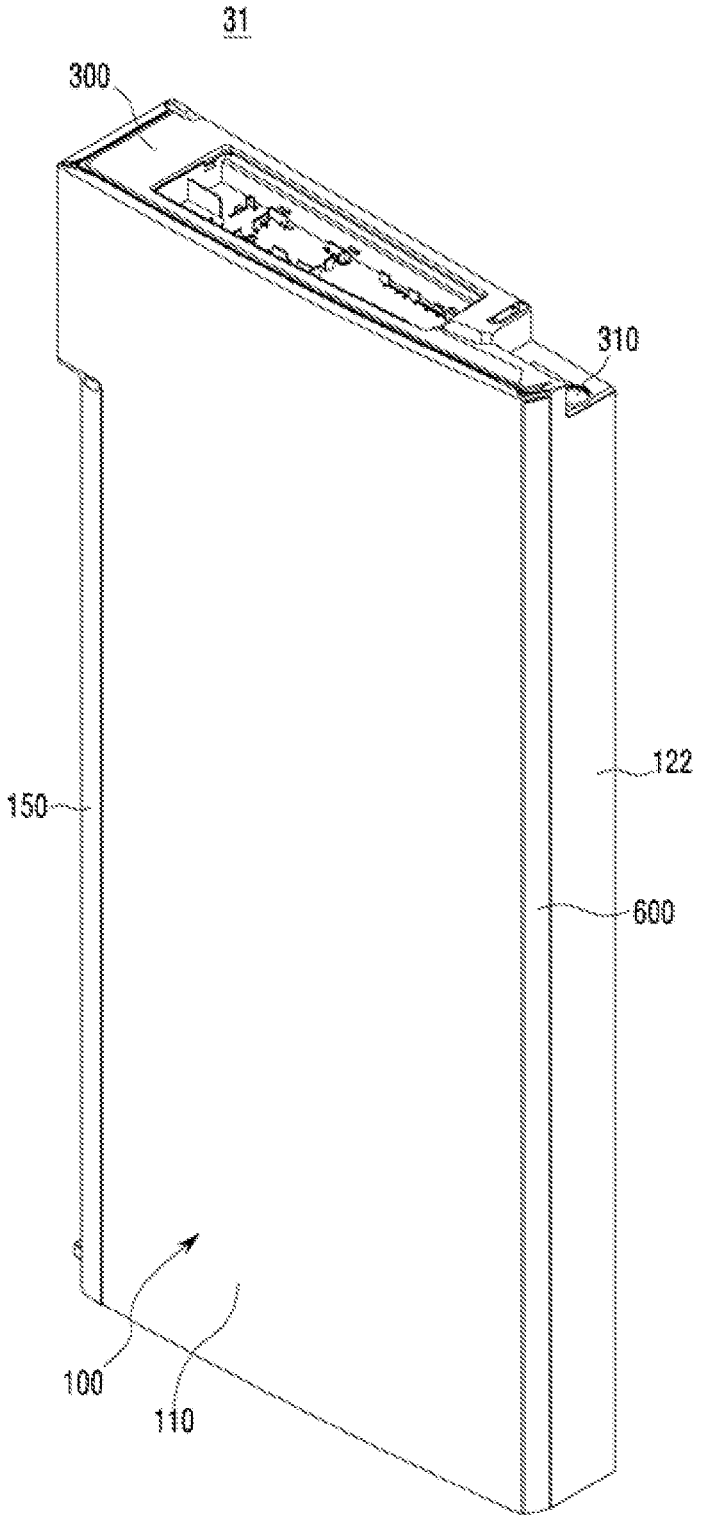
FIG. 2 is a perspective view of a door of the refrigerator of FIG. 1.
Figure 3:
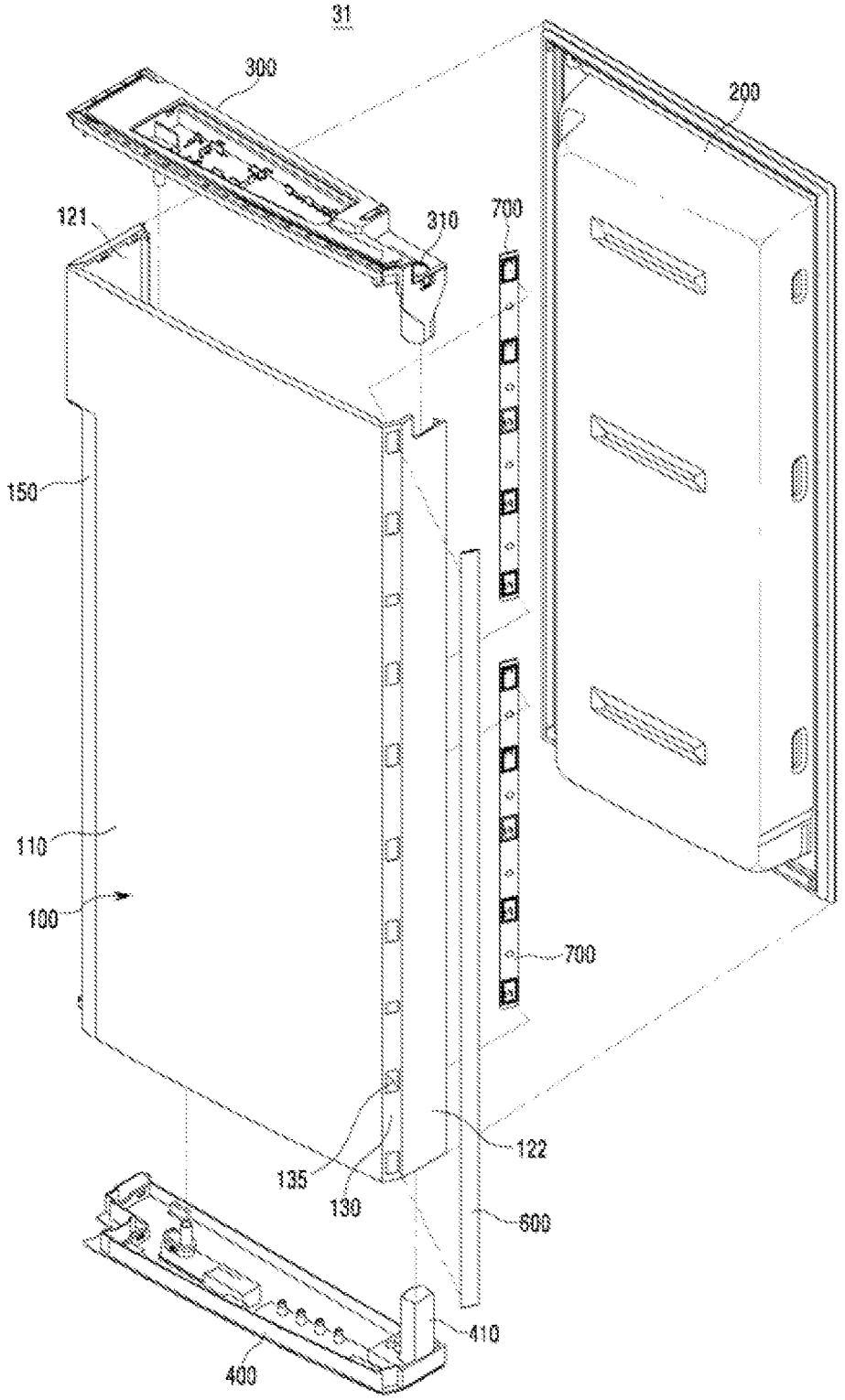
FIG. 3 is an exploded view illustrating the door of the refrigerator of FIG. 1.
Figure 4:
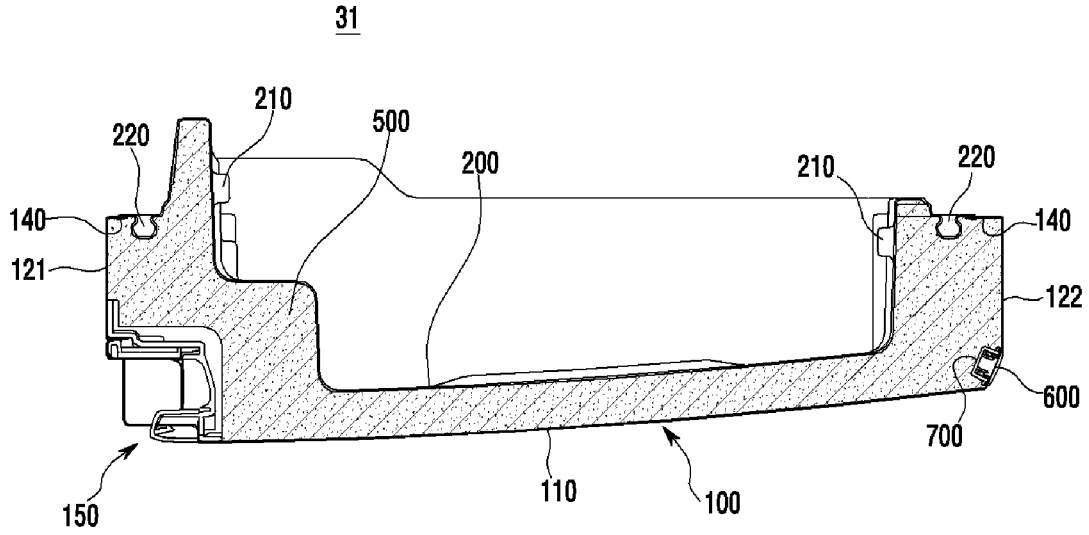
FIG. 4 is a plane cross-sectional view of the door of the refrigerator of FIG. 1.
Figure 5:
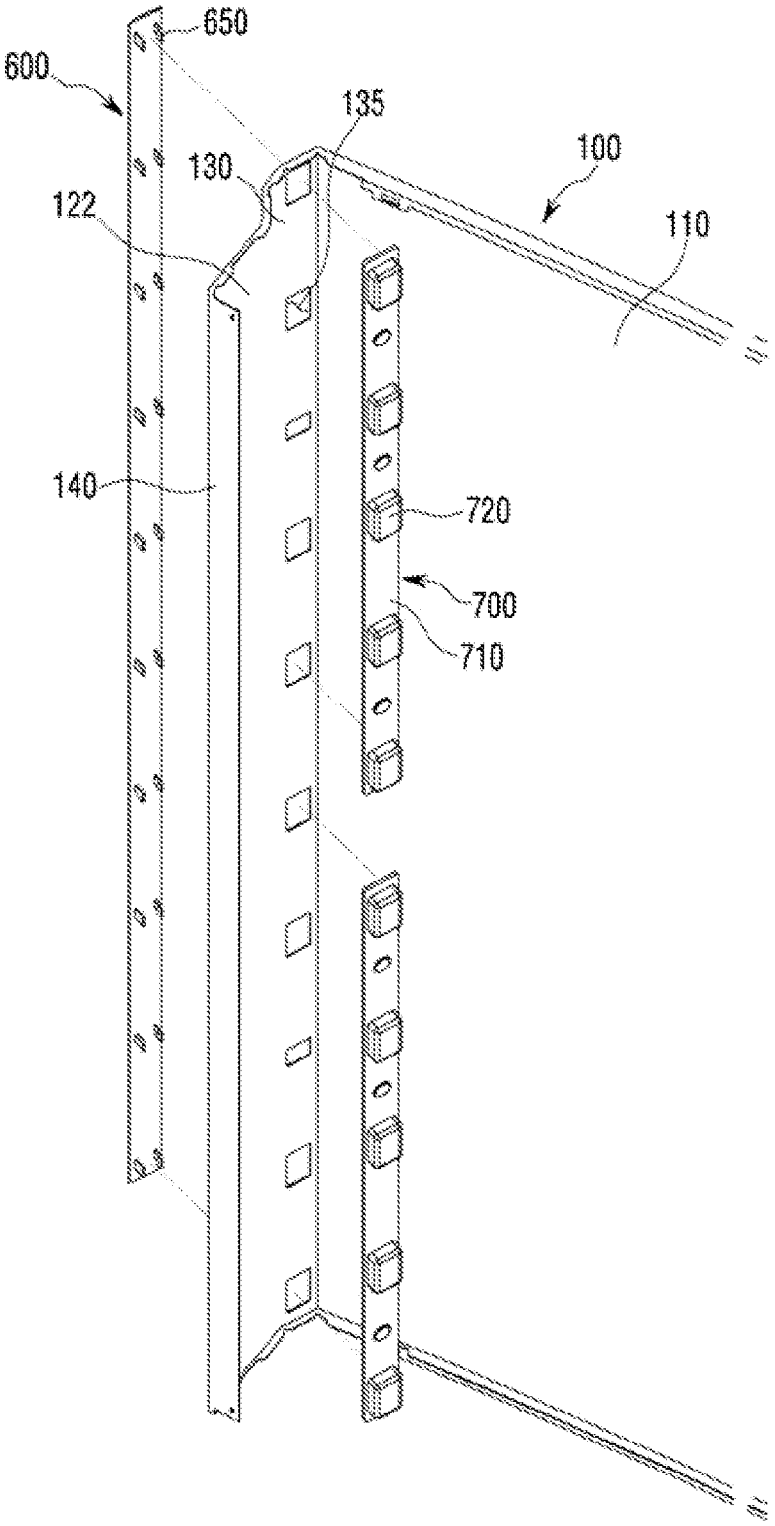
FIG. 5 is a perspective view illustrating a structure in which a decorative member is coupled to an edge portion of a front panel of the refrigerator of FIG. 1 by a hooking structure.
Figure 6:
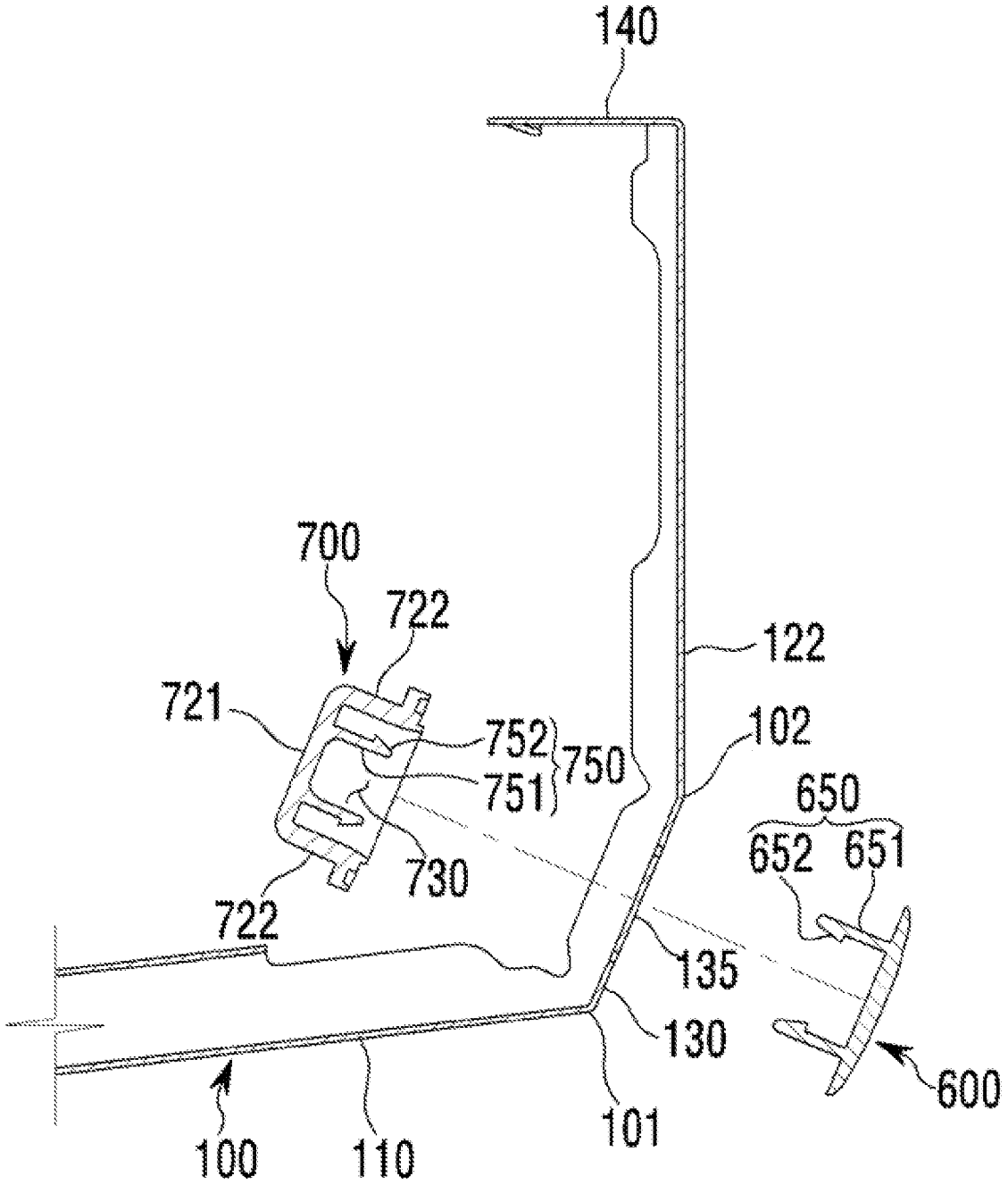
FIG. 6 is a plane cross-sectional view illustrating the structure in which the decorative member is coupled to the edge portion of the front panel of the refrigerator of FIG. 1 by the hooking structure.
Figure 7:
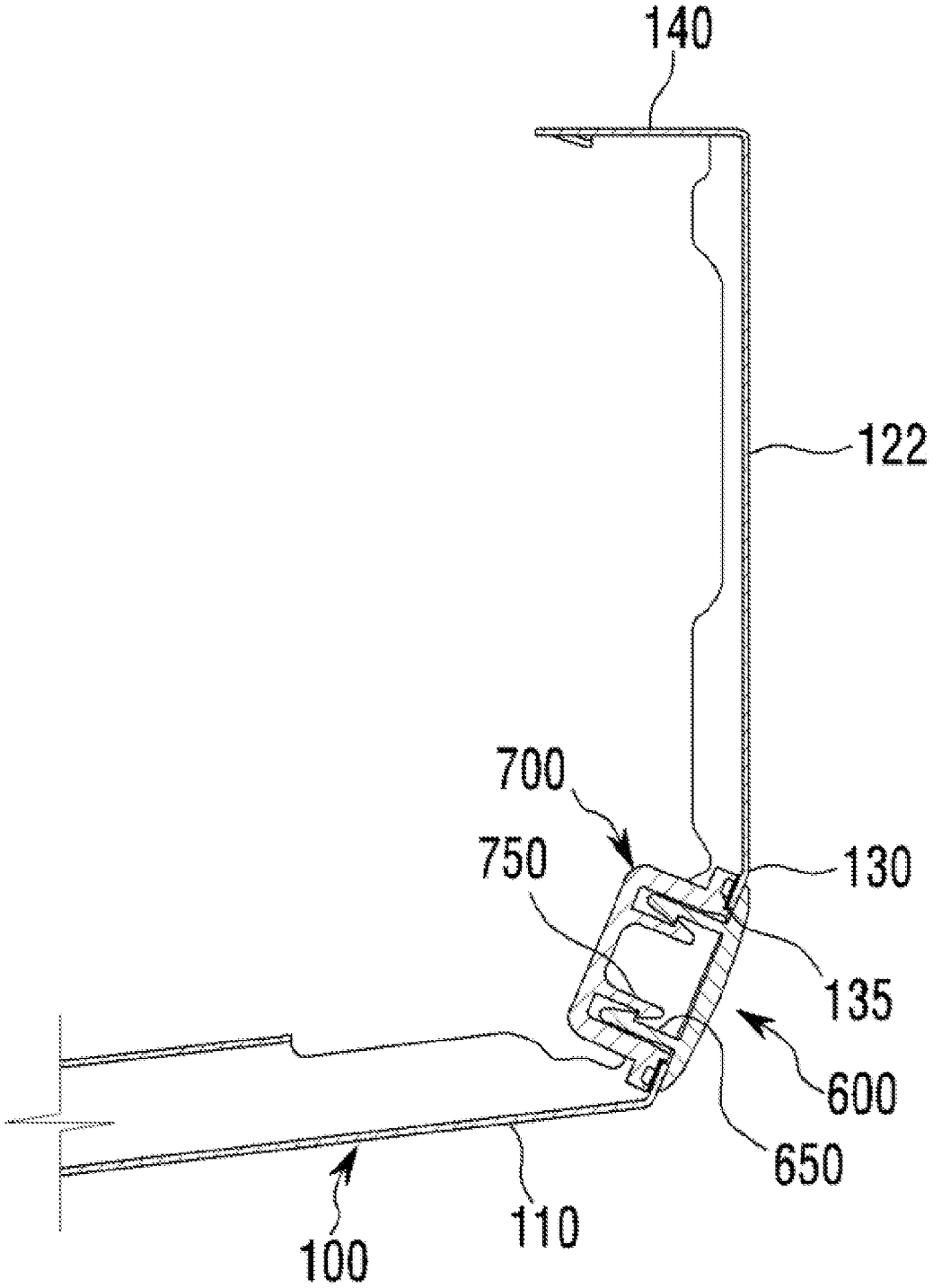
FIG. 7 is a plane cross-sectional view illustrating a state in which the decorative member is coupled to the edge portion of the front panel of the refrigerator of FIG. 1 by the hooking structure.
Figure 8:
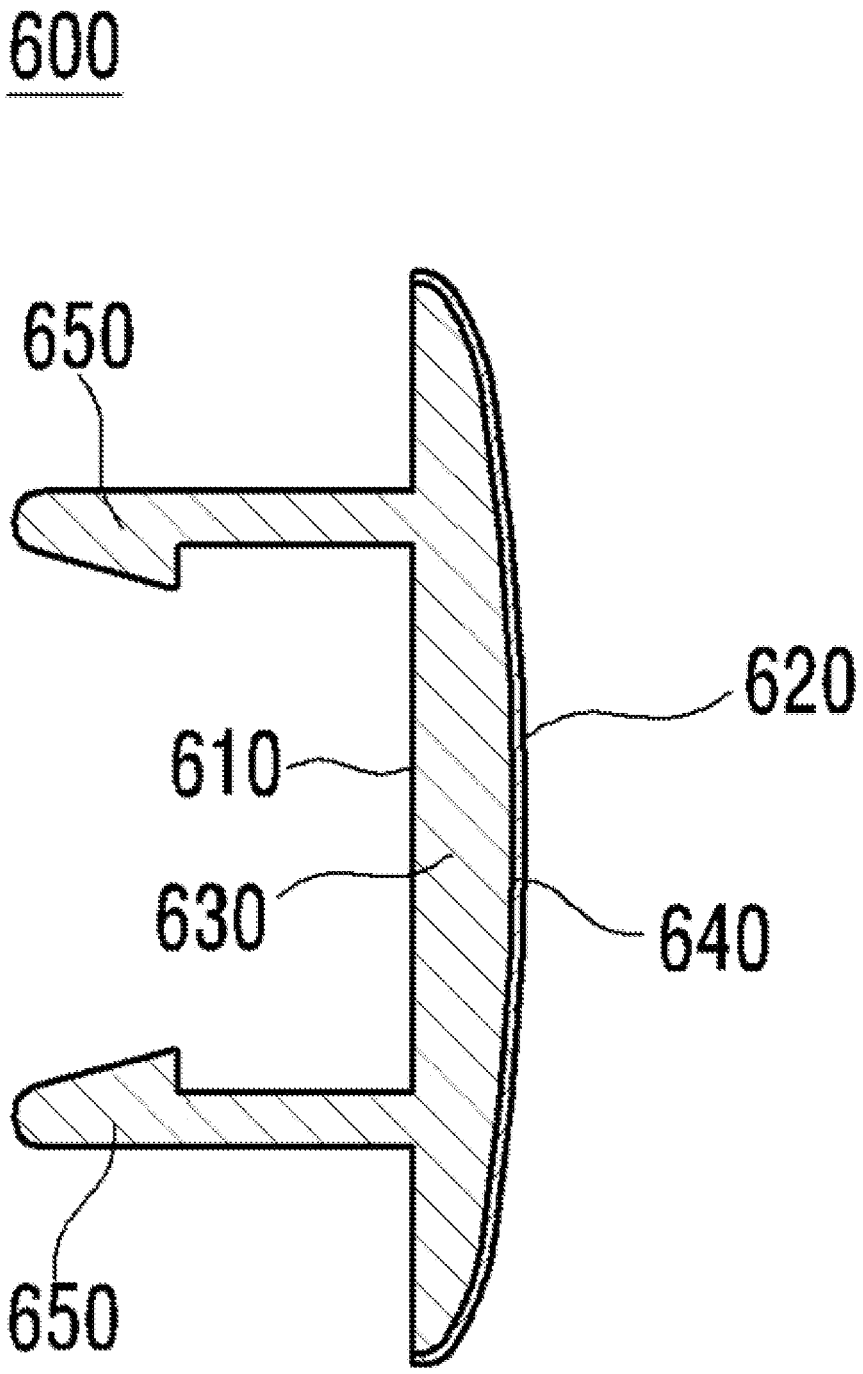
FIG. 8 is a cross-sectional view illustrating a structure of the decorative member of the refrigerator of FIG. 1.

FIG. 2 is a perspective view of a door of the refrigerator of FIG. 1, FIG. 3 is an exploded view illustrating the door of the refrigerator of FIG. 1, FIG. 4 is a plane cross-sectional view of the door of the refrigerator of FIG. 1, FIG. 5 is a perspective view illustrating a structure in which a decorative member is coupled to an edge portion of a front panel of the refrigerator of FIG. 1 by a hooking structure, FIG. 6 is a plane cross-sectional view illustrating the structure in which the decorative member is coupled to the edge portion of the front panel of the refrigerator of FIG. 1 by the hooking structure, FIG. 7 is a plane cross-sectional view illustrating a state in which the decorative member is coupled to the edge portion of the front panel of the refrigerator of FIG. 1 by the hooking structure, and FIG. 8 is a cross-sectional view illustrating a structure of the decorative member of the refrigerator of FIG. 1.

Referring to FIGS. 2 to 8, a door 31 may include the front panel 100 forming front and side exteriors of the door 31, the rear panel 200 coupled to the rear side of the front panel 100 and forming a rear exterior of the door 31, an upper cap 300 coupled to an upper portion of the front panel 100, a lower cap 400 coupled to a lower portion of the front panel 100, and an insulation material 500 provided at an inner space defined between the front panel 100 and the rear panel 200.

The rear panel 200 may be vacuum-formed from a resin material. The rear panel 200 may include a gasket coupling part 220 to which a gasket (not shown) is coupled, and a door guard supporting part 210 to which a door guard (not shown) is installed.

The upper cap 300 and the lower cap 400 may each be formed from the resin material, and may include hinge coupling parts 310 and 410, respectively.

The front panel 100 may be formed from a steel plate material. The front panel 100 may include a front portion 110 forming a front exterior of the door, side portions 121 and 122 forming side exteriors of the door, and a rear panel coupling part 140 to which the rear panel 200 is coupled.

The side portions 121 and 122 may include an inner side portion 121 which is relatively adjacent to a central portion of the refrigerator, and an outer side portion 122 which is disposed at an opposite side to the inner side portion 121. A handle portion 150 forming the handle 31 a may be coupled to the inner side portion 121.

The front panel 100 may be formed by bending the steel plate material a few times, such as bends 101 and 102, for example. Therefore, the front panel 100 may be formed integrally.

Further, the front panel 100 may include an edge portion 130 provided between the front portion 110 and the outer side portion 122. The edge portion 130 may have a shape formed by chamfering an angulated edge portion between the front portion 110 and the outer side portion 122.

That is, in the embodiment of the present disclosure, the edge portion 130 has a planar shape having a predetermined width, instead of a dot shape, a linear shape, or a curve shape. Therefore, the edge portion 130 is bent from the front portion 110, and the outer side portion 122 is bent from the edge portion 130.

In other words, the front portion 110, the edge portion 130, and the outer side portion 122 may be formed by bending the front panel 100 and thus formed integrally.

However, unlike in the embodiment, the edge portion 130 may have a curve shape.

The edge portion 130 may be provided to extend from an upper end of the door 31 to a lower end thereof.

In the embodiment of the present disclosure, the decorative member 600 is coupled to the edge portion 130 in order to provide aesthetic appeal through, for example, gloss, color, and texture. The decorative member 600 may be provided to extend from the upper end of the door 31 to the lower end thereof corresponding to the edge portion 130. This method of the decorative member 600 having the gloss or the like coupled to the edge portion 130 provides easier and more various aesthetic effects than when a glossing process is directly performed on the edge portion 130.

As illustrated in FIG. 8, the decorative member 600 may include a supporting surface 610 which is in close contact with and supported by an outer surface of the edge portion 130, and a decorative surface 620 which is provided at an opposite side to the supporting surface 610 to be exposed to an outside and to form an exterior.

The supporting surface 610 is formed to be in close contact with the outer surface of the edge portion 130. Therefore, if the outer surface of the edge portion 130 is formed to be flat, the supporting surface 610 is also formed to be flat.

On the other hand, the decorative surface 620 may not be formed to be flat, but formed to be rounded. Due to the rounded shape of the decorative surface 620, it is possible to further enhance the aesthetic effect of the decorative member 600.

The decorative member 600 may include a supporting layer 630 and a gloss layer 640. The supporting layer 630 is a body portion of the decorative member 600, and the gloss layer 640 is a portion which is formed on the supporting layer 630 to provide a decorative effect such as the gloss.

The decorative member 600 may be formed by plating the supporting layer 630 with a metallic material. At this time, the supporting layer 630 may be formed by injection-molding the resin material or extruding an aluminum material. The metallic material for the plating process may include silver, chrome, nickel, and so on.

Alternatively, the decorative member 600 may be formed in a dual extrusion manner, instead of the plating manner. That is, the decorative member 600 may be formed by dual-extruding the resin material and a gloss film having the gloss.

The decorative member 600 may be coupled to the outer surface of the edge portion 130 of the front panel 100 by a hooking structure. To this end, the refrigerator may further include a fixing member 700 which is disposed at an inner side of the edge portion 130 to fix the decorative member 600.

The decorative member 600 may include a hooking protrusion 650 which protrudes toward the fixing member 700. The hooking protrusion 650 may include a hooking extension portion 651 (FIG. 6) extending toward the fixing member 700, and a hooking interference portion 652 which is provided at an end of the hooking extension portion 651 to be thicker than the hooking extension portion 651.

Two hooking protrusions 650 which face each other form a pair, and multiple pairs of the hooking protrusions 650 may be provided in a lengthwise direction of the decorative member 600 to be spaced apart from each other at regular intervals.

The fixing member 700 may include a bar-shaped body portion 710 (FIG. 5) which is formed to be elongated in a lengthwise direction, and recessed portions 720 which are formed to be recessed from the body portion 710 toward an inner side of the door. The recessed portions 720 may be provided in a lengthwise direction of the body portion 710 to be spaced apart from each other at regular intervals.

The recessed portions 720 may include a bottom portion 721 (FIG. 6) which is provided to be approximately parallel with the body portion 720, a connection portion 722 which connects the body portion 710 and the bottom portion 721, and a receiving groove 730 which is formed by the bottom portion 721 and the connection portion 722. The receiving groove 730 may receive the hooking protrusion 650 and a corresponding protrusion 750 to be described later.

The corresponding protrusion 750 may protrude from the bottom portion 721 toward the decorative member 600. The corresponding protrusion 750 is a structure corresponding to the hooking protrusion 650 of the decoration member 600 and serves to mutually interfere with the hooking protrusion 650 and thus to fix the decorative member 600.

The corresponding protrusion 750 may include a corresponding extension portion 751 which extends toward the decorative member 600, and a corresponding interference portion 752 which is provided at an end of the corresponding extension portion 751 to be thicker than the corresponding extension portion 751.

Two corresponding protrusions 750 which face each other form a pair, and multiple pairs of the corresponding protrusions 750 may be provided in a lengthwise direction of the fixing member 700 to be spaced apart from each other at regular intervals.

A distance between one pair of the hooking protrusions 650 may be greater than that between one pair of the corresponding protrusions 750, and the hooking protrusions 650 and the corresponding protrusions 750 may be formed from a material having a desired elastic force.

Therefore, when the hooking protrusions 650 and the corresponding protrusions 750 approach each other, the hooking protrusions 650 are elastically deformed so that the distance therebetween is somewhat increased, and the corresponding protrusions 750 are elastically deformed so that the distance therebetween is somewhat reduced. Then, the hooking interference portion 652 of each of the hooking protrusions 650 and the corresponding interference portion 752 of each of the corresponding protrusions 750 interfere with each other and are prevented from being separated from each other.

As described above, the hooking protrusions 650 and the corresponding protrusions 750 interfere with each other and are prevented from being separated from each other. As a result thereof, the decorative member 600 may be fixed to the fixing member 700, and thus may be fixed to the edge portion 130.

Meanwhile, the edge portion 130 has through-holes 135 through which the hooking protrusions 650 pass. The plurality of through-holes 135 may be formed from an upper end of the edge portion 130 toward a lower end thereof to be spaced apart from each other at regular intervals corresponding to the hooking protrusions 650 and the corresponding protrusions 750.

The fixing member 700 which is provided at the inner side of the edge portion 130 to fix the decorative member 600 may be more firmly supported by the insulation material 500 as well as the hooking structure of the hooking protrusions 650 and the corresponding protrusions 750.

The insulation material 500 may be a urethane foam insulation material. The insulation material 500 may serve to thermally insulate the door and also to firmly adhere and support the front panel 100, the rear panel 200, the upper cap 300, the lower cap 400, and the fixing member 700 by its own adhesive force upon a foaming process.

Figure 9:
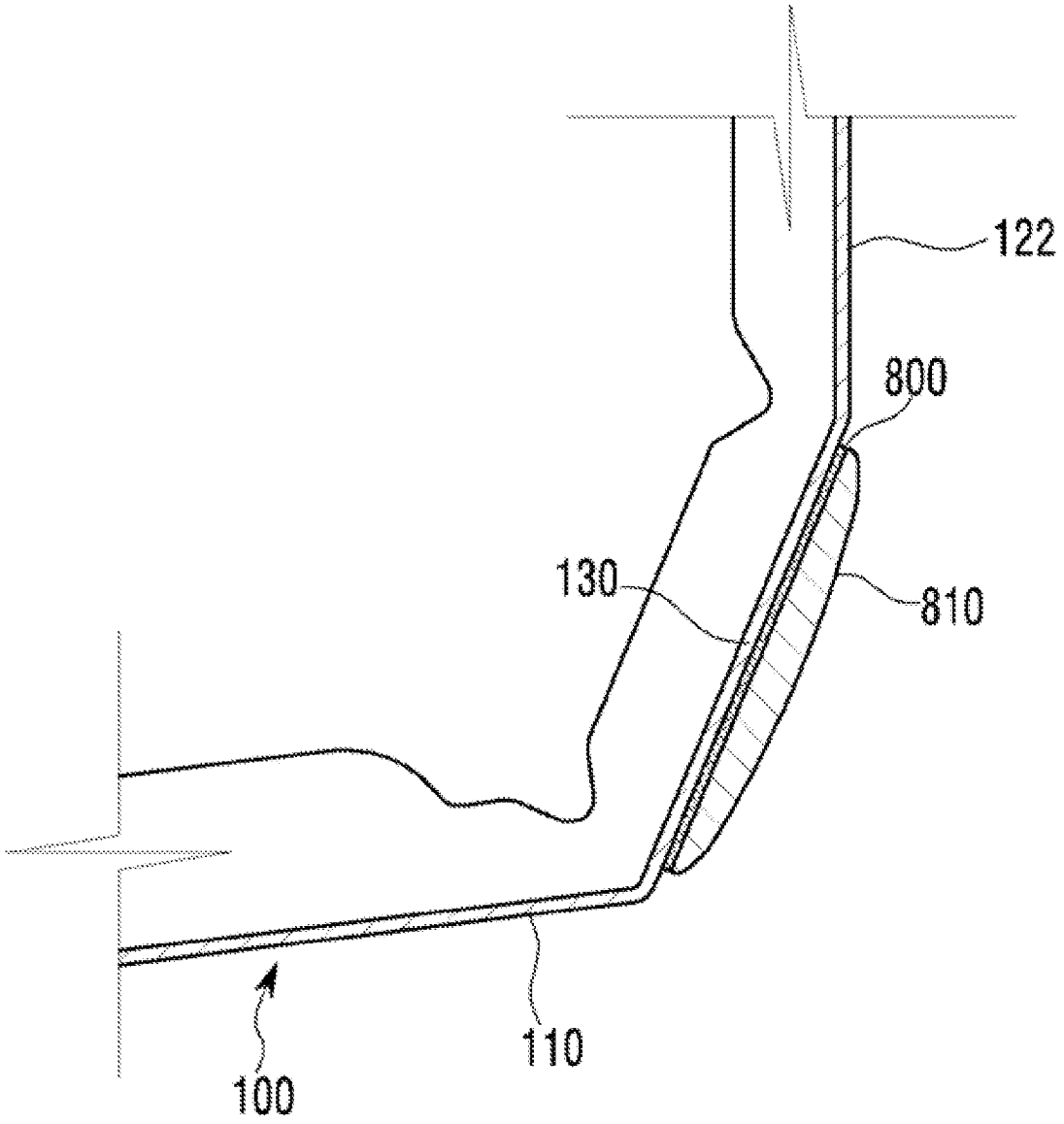
FIG. 9 is a plane cross-sectional view illustrating a structure in which the decorative member is coupled to the edge portion of the front panel of the refrigerator by an adhesive member in accordance with an embodiment of the present disclosure.
Figure 10:
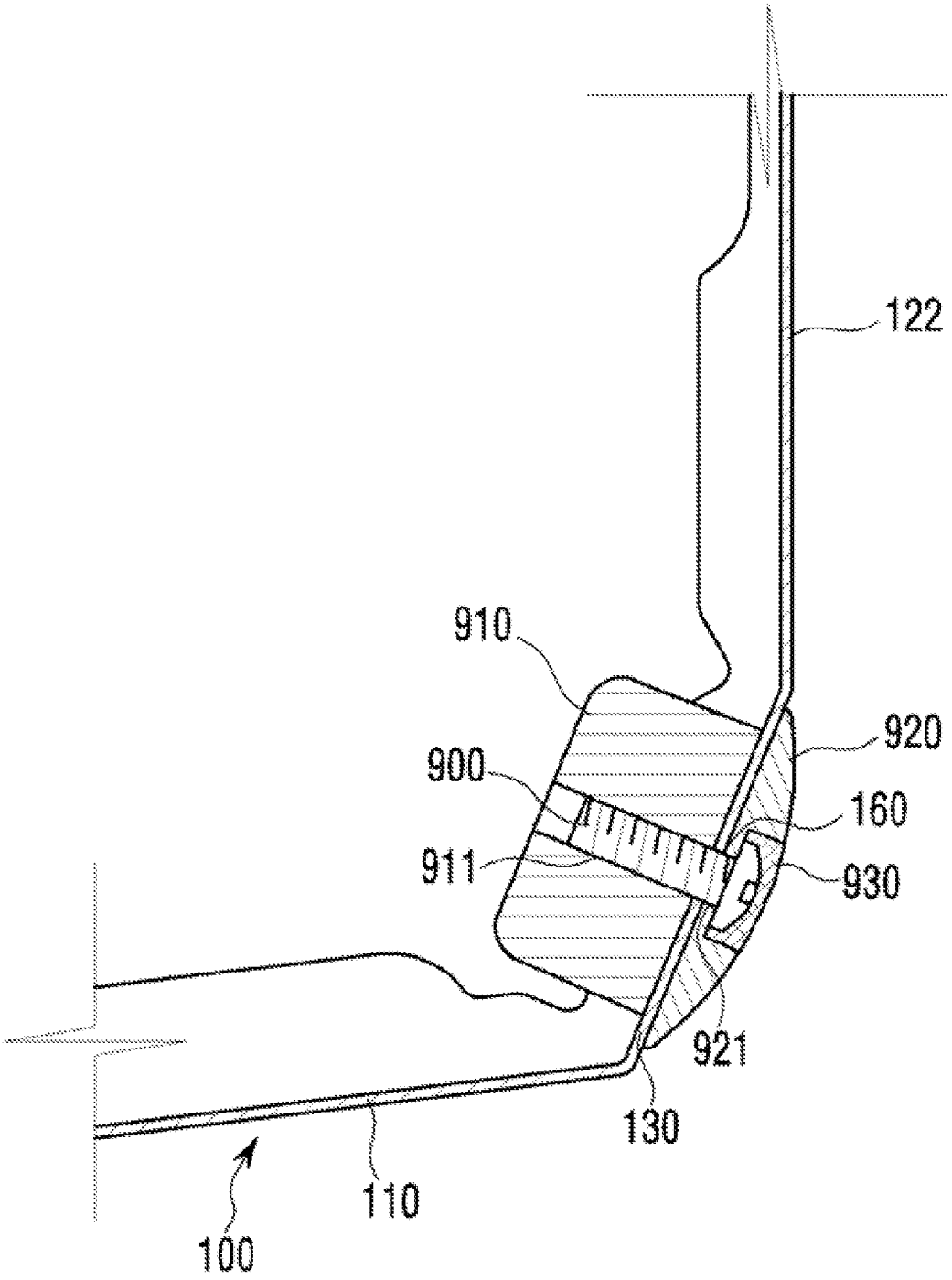
FIG. 10 is a plane cross-sectional view illustrating a structure in which the decorative member is coupled to the edge portion of the front panel of the refrigerator by a fastening member in accordance with an embodiment of the present disclosure.

FIG. 9 is a plane cross-sectional view illustrating a structure in which the decorative member is coupled to the edge portion of the front panel of the refrigerator by an adhesive member in accordance with an embodiment of the present disclosure, and FIG. 10 is a plane cross-sectional view illustrating a structure in which the decorative member is coupled to the edge portion of the front panel of the refrigerator of FIG. 1 by a fastening member in accordance with an embodiment of the present disclosure.

Referring to FIGS. 9 and 10, a structure in which the decorative member is coupled to the edge portion of the front panel of the refrigerator in accordance with an embodiment of the present disclosure will be described. The same reference numerals are given to the same parts as those described above, and the description thereof will be omitted.

As illustrated in FIG. 9, in an embodiment of the present disclosure, a decorative member 810 may be adhered to the edge portion 130 by an adhesive member 800. The adhesive member 800 may be a double-sided adhesive tape or another double-sided adhesive member.

According to the embodiment, the decorative member 810 does not need a separate hooking protrusion structure, and thus the fixing member which is a corresponding structure of the hooking protrusion. Further, the edge portion 130 does not have the through-holes 135. However, an adhesive structure using the adhesive member 800 of the embodiment together with the hooking structure of the first embodiment may be used.

As illustrated in FIG. 10, in an embodiment of the present disclosure, a decorative member 920 may be coupled to the edge portion 130 by a fastening member 900. Here, the fastening member 900 may include a screw, a bolt, a pin, or a rivet, for example.

In order to reinforce a fastening force of the fastening member 900, a reinforcing member 910 may be provided at the inner side of the edge portion 130. The reinforcing member 910 may be supported by the insulation material.

The fastening member 900 may pass through the decorative member 920 and the edge portion 130. To this end, each of the decorative member 920, the edge portion 130, and the reinforcing member 910 may have a fastening hole 921, 160, 911 for fastening the fastening member 900.

A decorative cap 930 may be coupled to a head portion of the fastening member 900 to prevent deterioration of the exterior due to exposure of the fastening member 900.

Figure 11:
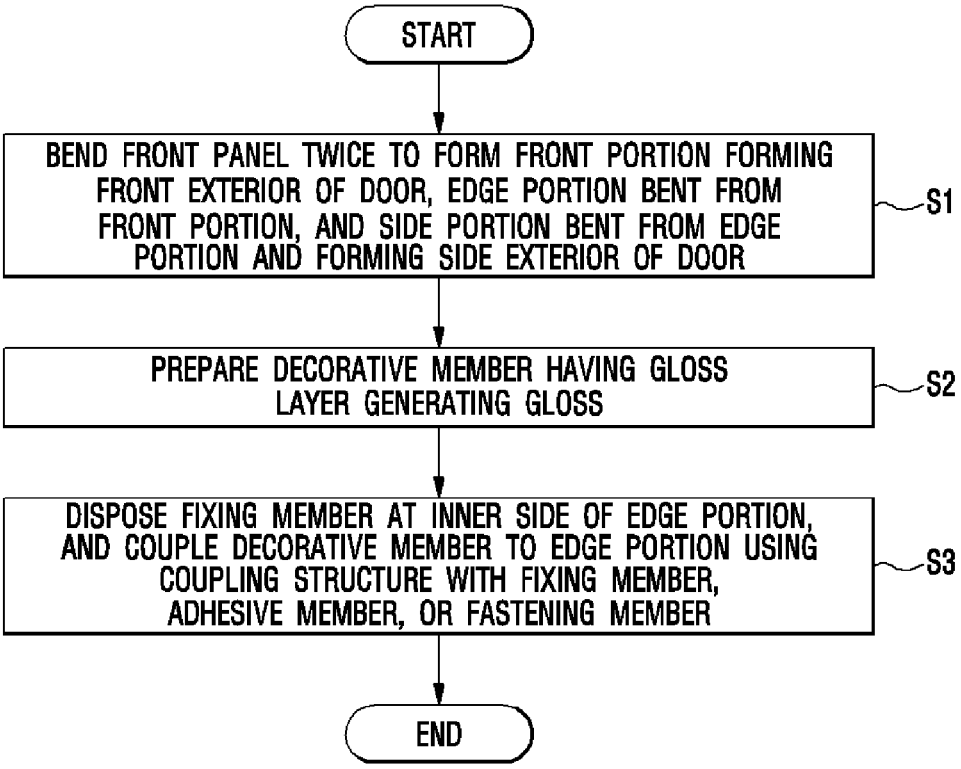
FIG. 11 is a flow chart of a main process of manufacturing the refrigerator in accordance with the embodiments of the present disclosure.

FIG. 11 is a flow chart of a main process of manufacturing the refrigerator in accordance with the embodiments of the present disclosure.

Referring to FIGS. 1 to 11, a manufacturing method of the refrigerator in accordance with the embodiments of the present disclosure will be described briefly.

In order to manufacture the door of the refrigerator including the main body, the storage chamber and the door which opens and closes the storage chamber, first of all, the front panel 100 formed from the steel plate material is prepared.

The front panel 100 is bent twice or more to form the front portion 110 forming the front exterior of the door, the edge portion 130 bent from the front portion 110 and a side portion 122 bent from the edge portion 130 and forming the side exterior of the door (operation S1).

The decorative member 600 to be coupled to the edge portion 130 of the front panel 100 is prepared (operation S2).

The supporting layer 630 is formed by injection-molding the resin material or extruding the aluminum material, and the gloss layer 640 is formed by plating the supporting layer 630 with the metallic material, whereby the decorative member 600 is manufactured. Alternatively, the decorative member 600 may be formed by dual-extruding the resin material and the gloss film having the gloss.

The decorative member 600 is coupled to the edge portion 130 of the front panel 100 (operation S3).

As a method of coupling the decorative member 600 to the edge portion 130, the fixing member 700 may be disposed at the inner side of the edge portion 130, and then the decorative member 600 and the fixing member 700 may be coupled to each other by the hooking structure.

The edge portion 130 and the decorative member 810 may be adhered to each other by the adhesive member 800 such as the double-sided adhesive tape.

The reinforcing member 910 may be disposed at the inner side of the edge portion 130, and then the decorative member 920, the edge portion 130 and the reinforcing member 910 may be coupled to each other by the fastening member 900 such as the screw, the bolt, the pin, and the rivet.

Figure 12:
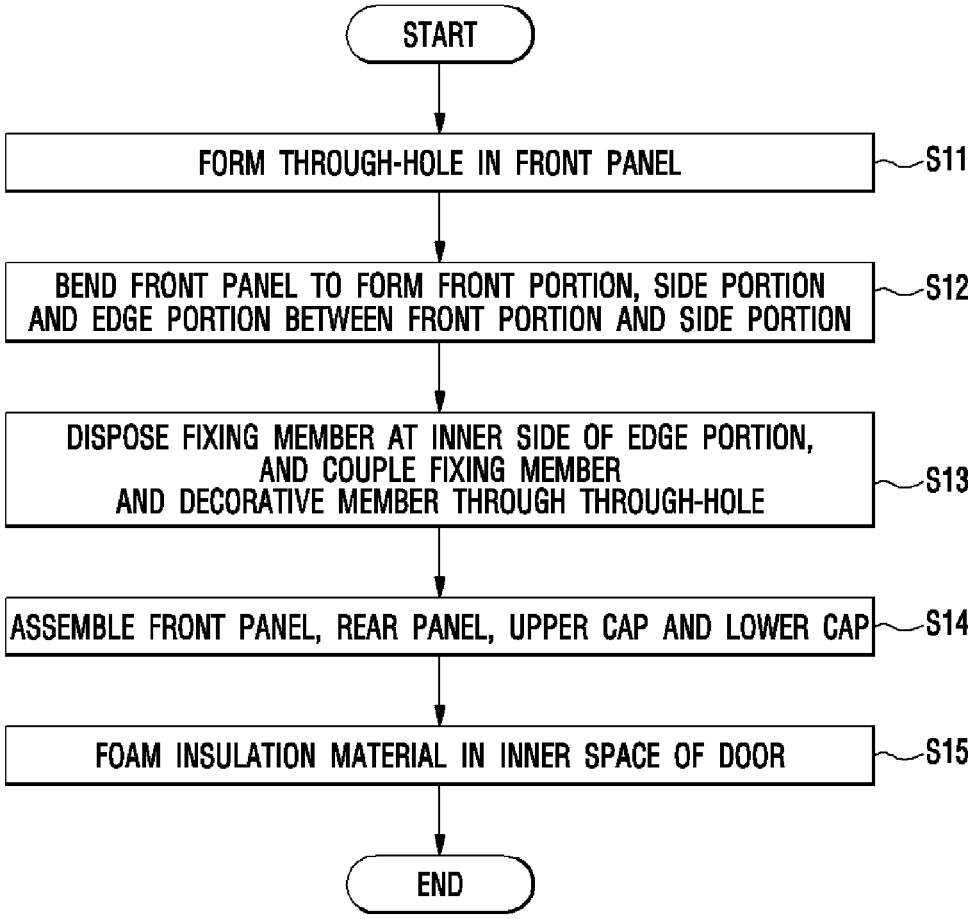
FIG. 12 is a flow chart of a main process of manufacturing the refrigerator in accordance with the embodiments of the present disclosure.

FIG. 12 is a flow chart of a main process of manufacturing the refrigerator in accordance with the embodiments of the present disclosure.

Referring to FIG. 12, a manufacturing method of the refrigerator in accordance with the embodiments of the present disclosure will be described.

The front panel 100 formed from the steel plate material is prepared, and the through-hole 135 through which the coupling structure for coupling the decorative member 600 and the fixing member 700 pass is formed in the front panel 100 (operation S11).

The front panel 100 is bent (operation S12). The front panel 100 is bent to form the front portion 110 of the front panel 100, the side portion 122 thereof and the edge portion 130 provided between the front portion 110 and the side portion 122.

The fixing member 700 is disposed at the inner side of the edge portion 130, and the decorative member 600 disposed at an outer side of the edge portion 130 is coupled to the fixing member 700 (operation S13). The coupling structure of the decorative member 600 and the fixing member 700 may pass through the through-hole 135.

The front panel 100, the rear panel 200, the upper cap 300, and the lower cap 400 are assembled (operation S14).

The insulation material 500 is injected and foamed into the space defined by the front panel 100, the rear panel 200, the upper cap 300, and the lower cap 400 (operation S15).

According to the spirit of the present disclosure, because the gloss is generated at the edge portion of the door, the door of the refrigerator has enhanced aesthetic appeal.

According to the spirit of the present disclosure, it is possible to easily provide the gloss to the edge portion by coupling the separate decorative member instead of directly performing the glossing process on the edge portion of the door of the refrigerator.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:
- a main body;
- a storage chamber provided in the main body; and
- a door opening and closing the storage chamber,
- wherein the door comprises:
  - a front panel comprising a front portion forming a front exterior of the door, an edge portion bent from the front portion, and a side portion bent from the edge portion and forming a side exterior of the door;
  - a rear panel coupled to a rear side of the front panel;
  - an insulation material provided at an inner space defined by the front panel and the rear panel;
  - a decorative member coupled to the edge portion and forming an edge exterior of the door; and
  - a fixing member which is disposed at an inner side of the edge portion to fix the decorative member.

2. The refrigerator according to claim 1, wherein the front portion, the edge portion, and the side portion are integrally formed by bending the front panel.

3. The refrigerator according to claim 1, wherein the front panel is formed from a steel plate material.

4. The refrigerator according to claim 1, wherein the edge portion is formed to be flat.

5. The refrigerator according to claim 1, wherein the decorative member extends from an upper end of the door to a lower end thereof.

6. The refrigerator according to claim 1, wherein the decorative member comprises a supporting surface which is in contact with and supported by an outer surface of the edge portion and a decorative surface which is provided at an opposite side to the supporting surface to form the edge exterior of the door.

7. The refrigerator according to claim 6, wherein the decorative surface is formed to be rounded.

8. The refrigerator according to claim 1, wherein the decorative member comprises a supporting layer formed from at least one of a resin material and an aluminum material, and a gloss layer which is provided on the supporting layer to generate a gloss.

9. The refrigerator according to claim 8, wherein the supporting layer is formed by at least one of injection-molding the resin material and extruding the aluminum material, and the gloss layer is formed by plating the supporting layer with a metallic material.

10. The refrigerator according to claim 8, wherein the decorative member is formed by dual-extruding the resin material and a gloss film having the gloss.

11. The refrigerator according to claim 1, wherein the decorative member comprises a hooking protrusion protruding toward the fixing member.

12. The refrigerator according to claim 11, wherein the fixing member comprises a corresponding protrusion which protrudes toward the decorative member to be coupled to the hooking protrusion and thus to fix the decorative member.

13. The refrigerator according to claim 12, wherein the edge portion comprises a through-hole through which at least one of the hooking protrusion and the corresponding protrusion passes.

14. The refrigerator according to claim 1, wherein the fixing member is supported by the insulation material.

15. A refrigerator comprising:

a main body;

a storage chamber provided in the main body; and a door opening and closing the storage chamber, wherein the door comprises:

a front panel comprising a front portion forming a front exterior of the door, an edge portion bent from the front portion, and a side portion bent from the edge portion and forming a side exterior of the door;

a rear panel coupled to a rear side of the front panel;

an insulation material provided at an inner space defined by the front panel and the rear panel;

a decorative member coupled to the edge portion and forming an edge exterior of the door; and a fastening member which passes through the decorative member and the edge portion to fix the decorative member, and a reinforcing member which is provided at the inner side of the edge portion to reinforce a fastening force of the fastening member.

16. A refrigerator comprising:

a main body;

a storage chamber provided in the main body; and a door opening and closing the storage chamber, wherein the door comprises:

a front panel;

a rear panel coupled to a rear side of the front panel;

an insulation material provided at an inner space defined by the front panel and the rear panel;

an edge portion formed at an edge of the door;

a decorative member coupled to the edge portion and forming an edge exterior of the door; and a fixing member which is provided at the inner space of the door to fix the decorative member and supported by the insulation material.

17. The refrigerator according to claim 16, wherein the edge portion has a through-hole through which a coupling structure coupling the decorative member and the fixing member passes.

* * * * *